US005670013A

United States Patent [19]

Huang et al.

[11] Patent Number: 5,670,013

[45] Date of Patent: Sep. 23, 1997

[54] DIES FOR MANUFACTURING A PACK OF SELF-OPENING BAGS

[75] Inventors: Frank Feng Jung Huang; Daniel C. Huang, both of Irvine, Calif.

[73] Assignee: Durabag Co., Inc., Tustin, Calif.

[21] Appl. No.: 328,154

[22] Filed: Oct. 24, 1994

Related U.S. Application Data

[62] Division of Ser. No. 17,636, Feb. 12, 1993, abandoned.

[51] Int. Cl.[6] ..... B26F 1/14; B31B 1/14; B31B 1/20

[52] U.S. Cl. ..... 156/513; 83/682; 83/684; 156/251; 156/252; 156/306.3; 156/515; 156/530; 206/554; 383/9

[58] Field of Search ..... 156/306.3, 513, 156/251, 515, 252, 530, 580, 581; 206/554; 493/204, 354, 203, 194–197; 83/682, 684; 383/8, 9

[56] References Cited

U.S. PATENT DOCUMENTS

| | | | |
|---|---|---|---|
| 4,811,417 | 3/1989 | Prince et al. | 383/9 |
| 4,989,732 | 2/1991 | Smith | 383/9 X |
| 5,074,674 | 12/1991 | Kuklies et al. | 206/554 X |
| 5,087,234 | 2/1992 | Prader et al. | 206/554 X |
| 5,188,235 | 2/1993 | Pierce et al. | 206/554 |
| 5,207,328 | 5/1993 | Bose et al. | 206/554 X |
| 5,269,605 | 12/1993 | Nguyen | 206/554 X |
| 5,484,376 | 1/1996 | Prader et al. | 493/204 X |

*Primary Examiner*—Adrienne C. Johnstone
*Attorney, Agent, or Firm*—Daniel R. Kimbell

[57] ABSTRACT

Dies are used in forming a pack of self-opening plastic T-shirt bags for use with a bagging rack. Each plastic bag in the pack of bags has a mouth tab portion between its two upwardly extending handles, which are at the sides of the mouth of the T-shirt bags. The mouth tab portion is located on the front and rear walls in the mouth region of the plastic bags. The mouth tab portion has an aperture for receiving a retaining projection of a bagging rack. Frangible pressure bonding is formed along the perimeter of the mouth tab aperture. Flapless handle apertures are also formed in the handles, with frangible pressure bonds formed along their perimeter edges. Due to the frangible bonding formed between adjacent bags, as a frontmost bag is removed from the pack of bags on the bagging rack, the next bag in the pack of bags will automatically self-open into a open position for loading with merchandise. The frangible bonding is formed with dies having a die portion with a cutting edge and having compression portion, with a generally blunt leading edge, positioned in close proximity to the die portion.

8 Claims, 6 Drawing Sheets

FIG. 1
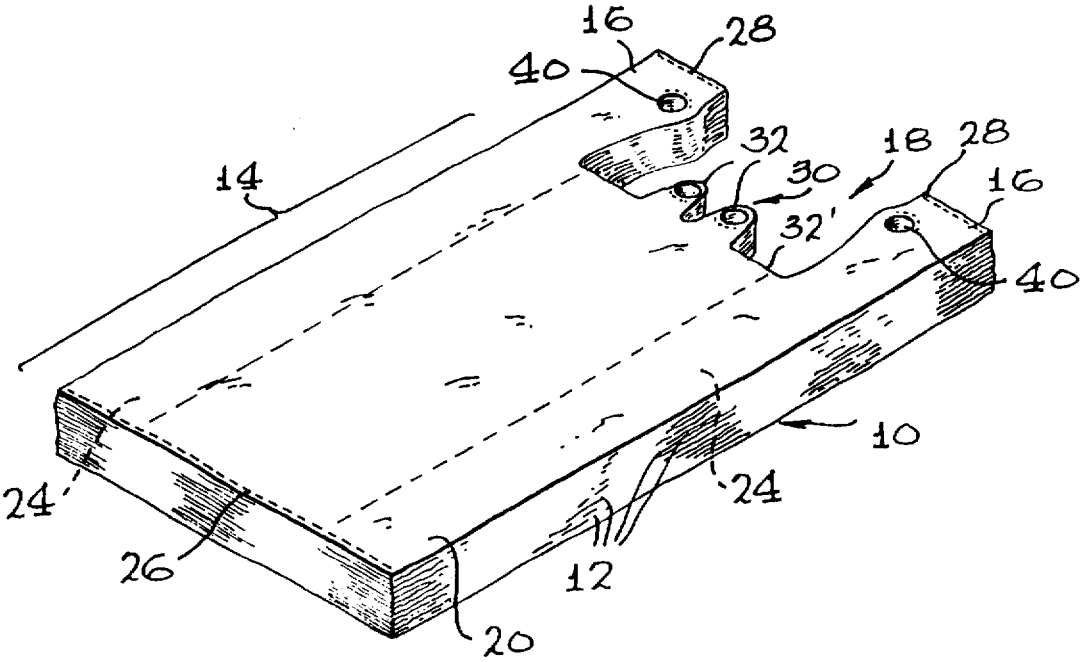
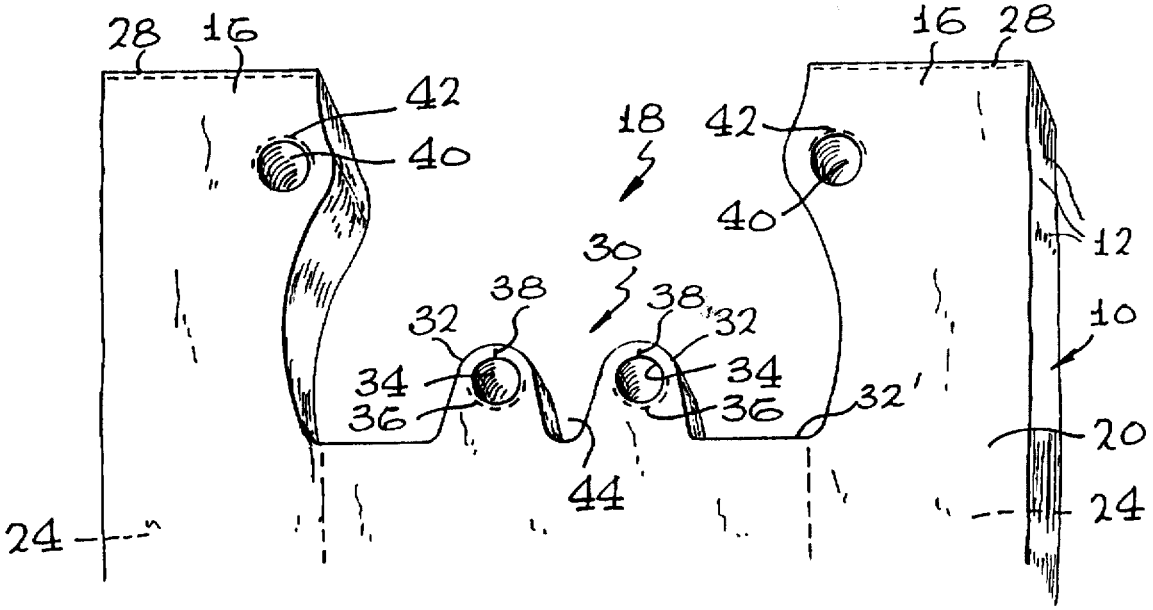
FIG. 2

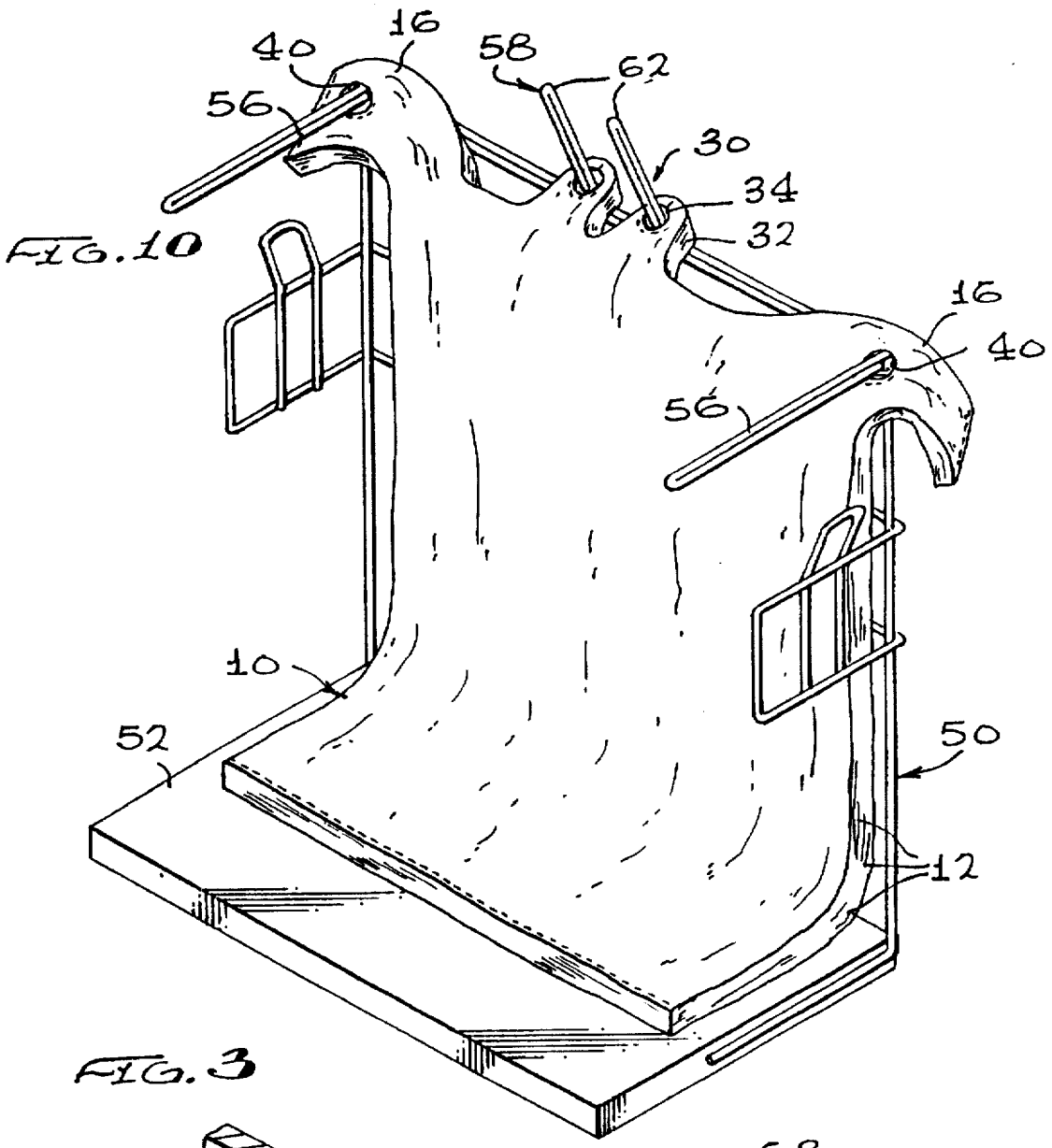
FIG. 10
FIG. 3
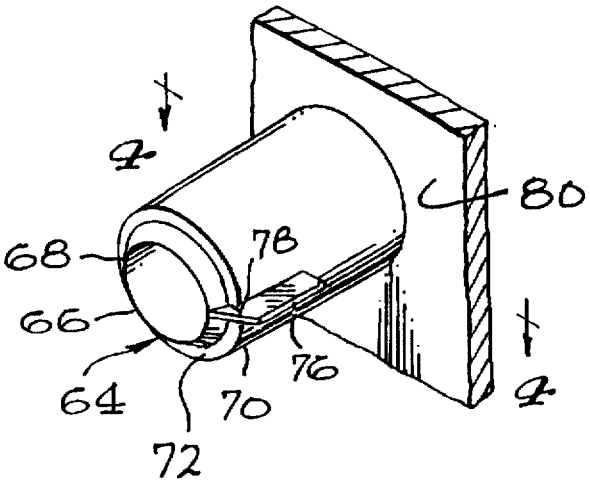
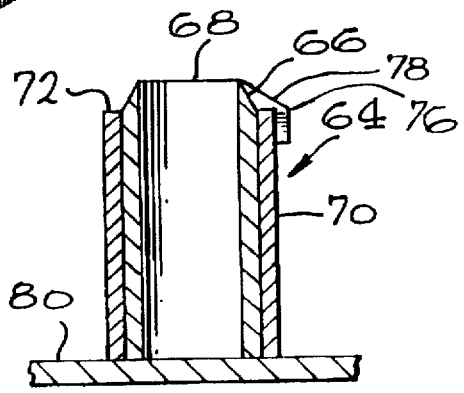
FIG. 4

FIG. 5
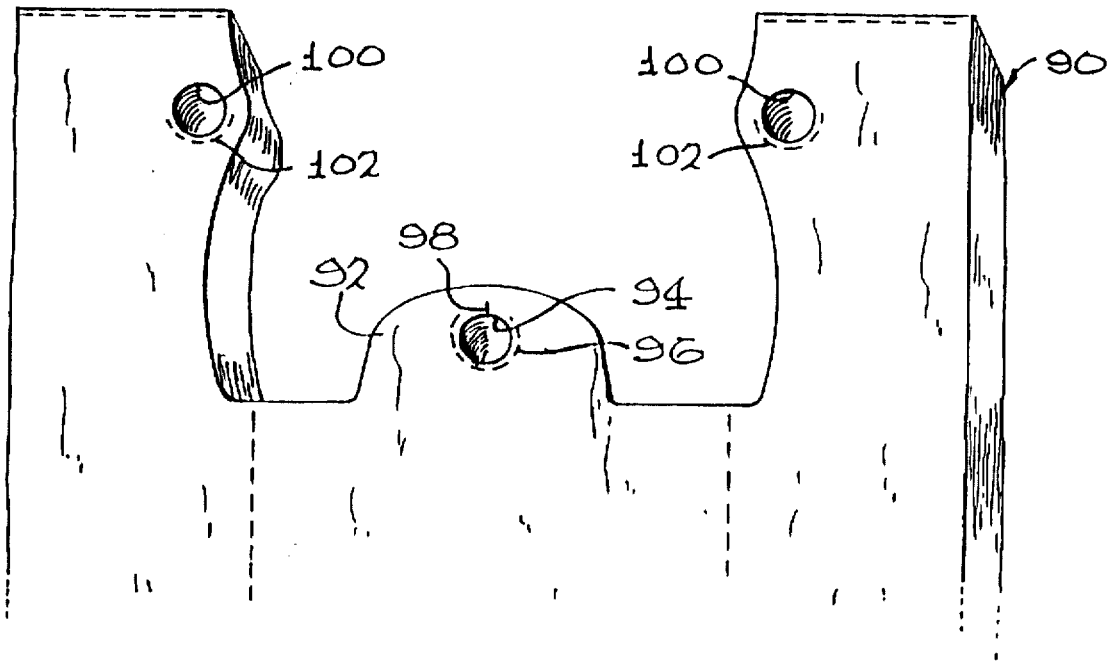
FIG. 6
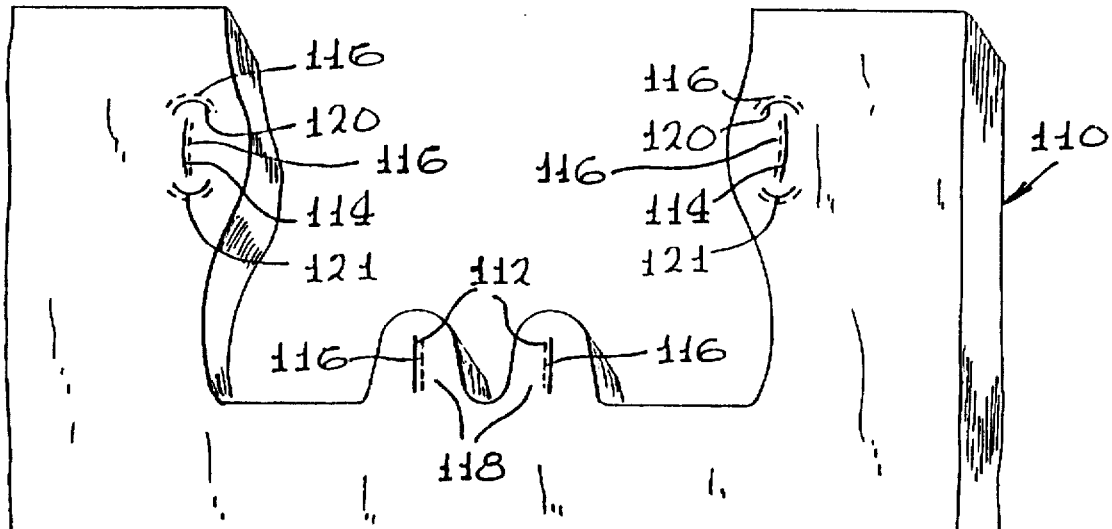
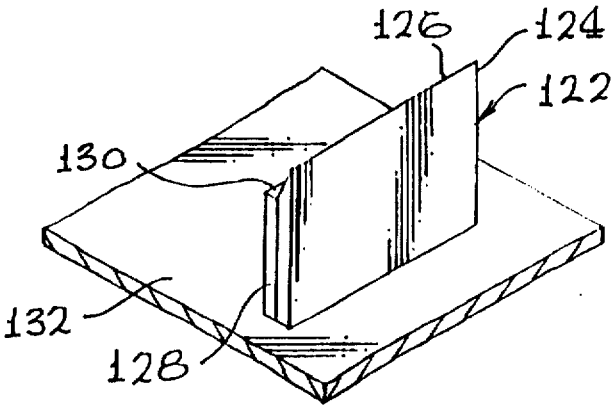
FIG. 7

DIES FOR MANUFACTURING A PACK OF SELF-OPENING BAGS

This application is a division of application Ser. No. 08/017,636, filed Feb. 12, 1993, now abandoned.

BACKGROUND OF THE INVENTION

1. Field of the Invention

This invention relates to plastic bags, and more particularly to a pack of T-shirt bags, merchandise bags, trash bags, and the like made preferably of polyolefins, and method of manufacturing same, which can be used with or without bagging racks and which provide for self-opening of the bags as each bag is removed from the pack of bags.

2. Description of the Prior Art

Since the mid-1980's, the use of plastic shopping bags has grown dramatically due to the great advantage plastic bags have over bags made of other materials, such as paper. Many types of plastic bags are made of low or high density polyethylene (LDPE and HDPE, respectively), but can be made of any of the polyolefins. LDPE and HDPE bags are stronger, lighter and much more compact to store than paper bags, saving valuable storage space at the merchants' check-out counter and storage areas. These attributes also make these bags less expensive to transport. LDPE and HDPE bags can be manufactured and sold at a fraction of the cost of competing paper bags, making them the bags of choice for merchants. LDPE and HDPE bags are also actually more environmentally friendly than paper bags since they require about 70 percent less energy to manufacture than competing paper bags and are readily recyclable, and when not recycled, are non-toxic when incinerated or disposed of in landfills.

Many groceries stores and other merchants now use a style of plastic bag to bag groceries and other merchandise commonly referred to as T-shirt bags. T-shirt bags are pleated bags which are closed, by heat sealing, at a bottom edge, and have a pair of integral loop handles extending upwardly to define an open mouth of the bag therebetween. Because high density polyethylene (HDPE) has a greater resistance to stretching and deformation than LDPE plastic, HDPE plastic is generally used for making T-shirt bags, although LDPE and other polyolefins can also be used. T-shirt bags are normally provided in packs of aligned bags and these packs of bags are usually used in conjunction with bagging racks.

T-shirt bags are generally manufactured by the following process. A continuous tube of HDPE plastic, or other plastic materials having the desired color, thickness, and diameter is formed on a extruding machine. The continuous plastic tube is then passed over rollers to roll the continuous plastic tube onto a spool. If the bags to be formed from the continuous tube of HDPE are to be printed on one or both sides, the newly formed continuous plastic tube will be subjected to corona surface treatment, wherein the side or sides of the continuous flattened tube of plastic to be later printed will be passed by a high voltage corona discharge electrode. Corona surface treatment affects electrical and chemical changes on the plastic's outer surface to prepare that surface of the bag for printing. Regardless of whether or not the bags will be printed on one or both sides, it is a common practice in the plastic bag manufacturing industry to corona surface treat the entire outer surface of the rolls of continuous plastic tubing so that printing can be done on either one or both sides, if desired. It has been found that corona surface treatment, or other known methods to electrically and chemically change the entire outer surface of the continuous plastic tube, contributes somewhat to the self-opening feature of applicants' plastic bag pack system.

After being corona surface treated and rolled (if the bags might be printed), the roll of continuous plastic tube is unrolled and is then pleated on a pleated machine. Following this, a bagging machine heat seams and cuts sections of the pleated tube at top and bottom edges to form closed and flattened pleated bags of a desired length and width, with the pleated sides being at both sides of the flattened pleated bags. These sections are often referred to as pillowcases. Further downstream of the heat seaming and cutting step, the pillowcases are stacked in aligned stacks. Thereafter, hydraulic die cutting or other cutting methods are utilized to remove material at the stacked pillowcases' top portions to form the handles with apertures passing therethrough, and to form a mouth tab portion with an aperture to support the pack of self-opening bags on hooks positioned on a bagging rack. Each loop handle will comprise four layers of plastic material since they are cut out from the pleated side portions of the bag.

Despite the many advantages HDPE T-shirt bags have over paper bags, they are not self-standing like thicker and stiffer paper bags with a discreet flat bottom. This is due to their relatively thin and flexible material. In grocery stores settings, where quick and easy loading of Bags is desirable, packs of T-shirt bags are generally supported on a bagging rack as merchandise is loaded into the bags to overcome the lack of a self-standing ability.

There are several popular styles of T-shirt bags available in packs of bags and bagging racks for use therewith, two main types of which will be discussed.

In one type of pack of T-shirt bags and bagging racks used therewith, the bagging rack has a support base, a wire rear wall with a tab receiving hook, and two wire arms extending forwardly over the base. In the center top portion of the arms, the wire is formed so as to have a section which will spread and hold apart the handles of T-shirt bags engaged therewith to open up the mouth of the T-shirt bag. The pack of T-shirt bags used with these styles of bagging racks consists of a stack of overlapped and aligned bags which have a lower bag portion with two handles extending upwardly at both sides of the mouth of the bag. A central tab portion is provided on the mouth of the bags between the two handles, and the central tab portions of the pack of bags are heat-sealed together. The heat sealed central tabs thus form a stack or book of central tabs and have a central tab slit formed therethrough. The central tab slit is engaged with the tab receiving hook on the rear wall of the bagging rack, and the book of central tabs will remain engaged therewith, even after individual bags are removed. Below the central tab slit a tearing slit is provided which traverses almost the entire distance of the central tabs except for a small distance at both sides of the central tab portion. The tearing slit allows the individual bags to be torn off the pack of bags as they are needed, and looped onto the bagging rack.

A second major type of pack of T-shirt bag, and bagging rack designed to be used therewith, are disclosed in U.S. Pat. No. RE 33,264 to Baxley et al. Another version of this style of bagging rack is disclosed in U.S. Pat. No. 4,840,336 to Stroh et al. Both of these bagging racks have a bottom support base and a rear wire wall with a tab receiving hook located thereon. However, to open up each individual bag for loading, instead of looping the handles of the bags over the top of the support arm one at a time, as is done with the first type of pack of bags and rack, these racks have two handle support rods extending forwardly from the rear wire wall of the racks. The pack of T-shirt bags used with these styles of racks are similar to those used with the first type of rack, except that aligned apertures with flaps are formed on each handle of the pack of bags, through which pass the handle support rods of the bagging racks.

The prior art packs of T-shirt bags suffer from drawbacks. Prominent among these drawbacks include the lack of a convenient and easy to manufacture self-opening feature, to eliminate the need for the box person to struggle to open up each bag in the pack of bags.

In order to prepare a T-shirt bag for loading with merchandise, only the first layer of the bag material of the top bag, and no other layers must be pulled forward, thereby opening just the top bag. Since the HDPE material is very thin, typically between 1 to 0.5 mil thick (0.001 and 0.0005 inches), it is sometimes difficult for the checkout clerk or box person to grasp just the top layer of bag material. One can often see a sponge or source of tacky material, such as a glue stick, retained at the top of bagging racks, with which the checkout clerk or box person can dampen his or her fingers to aid in grasping just the top layer of material of the bag. However, this takes additional time and effort in the bagging process. This cycle will have to be repeated with each successive bag to be loaded.

In addition, the prior art bag packs systems all leave waste books of heat bonded central tabs on the bagging rack. These books accumulate on the bagging rack and must be thrown out. Thirdly, in those styles of packs of bags which employ a central tab slit through their central tabs for mounting the pack of bags on a tab receiving hook of a bagging rack, it is sometimes difficult to engage the slitted central tab with the tab receiving hook. For those styles of bags packs having bagging rack suspension arm apertures defined by flaps through their handles for suspending the bag handles on bagging racks with suspension arms, the presence of the flaps in the apertures often make it difficult for the person loading a pack of bags to place the pack of bags on the rack.

Several approaches have been taken to overcome the lack of a self-opening feature problem. U.S. Pat. No. RE 33,264 to Baxley et al. discloses a pack of T-shirt bags wherein spots of adhesive are placed between the rear walls of the forwardly lying bags and the front walls of the rearwardly lying bags. The use of these spots of adhesive is intended to provide for self-opening of the bags as each successive bag is pulled off the pack of bags on the bagging rack. However, the use of spots of adhesive is undesirable from a cost and reliability standpoint because an extra manufacturing step of depositing spots of adhesive on the growing stack of pillowcases as each subsequent pillowcases is stacked thereon is required.

U.S. Pat. No. 5,074,674 to Kuklies et al. discloses a packs of bags similar to that of Baxley, et al. wherein the front wall of each bag is either relieved or removed in the region of the central tab so as not to be retained by the tab receiving hook on the bagging rack, purportedly allowing the front wall of the bag to be grasped more easily to open the bag. However, this style also requires an extra, and difficult manufacturing step of removing or relieving a portion of only the front wall of each bag. The pack of bags of Kuklies, et al. does not provide for self-opening of the bags.

U.S. Pat. No. 4,877,473 to Snowden et al. discloses a pack of bags wherein the tearing line has a central arched portion which forms a sub tab. This sub tab can be easily grasped and pulled forward to pull the front wall of each bag to open that particular bag. However, each subsequent bag in the pack of bags must be opened in the same manner, and thus the desired self-opening feature is absent.

U.S. Pat. No. 5,087,234 to Prader et al. discloses an easy-open bag pack wherein the easy-open featured results from corona discharge treating a tube of polyethylene film, transverse sealing to form pillowcases of the plastic material, stacking the pillowcases, and applying sufficient pressure to a cutting device to form the handles therein.

U.S. Pat. No. 5,183,158 to Boyd et al. discloses a bag pack and dispensing system wherein the pack of bags has a self-opening feature, which arises out of frangible pressure bonding areas located on the handles, distant the bag rack handle suspension slits, and both below the optional mouth tab and near the lower portions of the pack of bags, near its bottom edge. For a bag pack of the form of Boyd et al., without a suspension mouth tab, the reliability of the self-opening feature as each successive bag is pulled off the pack of bags may be compromised. For the bag packs of Boyd et al. with a suspension mouth tab, Boyd et al. teaches the preference of having its mouth tab's front side unattached to the back wall of the mouth tab. Front side free mouth tab structures are more difficult and costly to manufacture than conventional bag structure.

Despite the attempts to overcome the problems associated with these presently available bags, there remains a need for an improved pack of T-shirt bags which (1) can be easily manufactured, yet which provides for reliable self-opening of each bag of the pack of bags, (2) does not leave a book of plastic tabs on the bagging rack, and (3) can be easily placed on a bagging rack.

SUMMARY OF THE INVENTION

The present invention overcomes the above noted deficiencies of the presently available bags by providing a new type of pack of self-opening bags and a bagging rack for use therewhich, which pack of bags has a self-opening feature that permits successive bags of the pack of bags to be self opened from the pack of bags.

The invention provides a pack of self-opening bags for use with a bagging rack having suspension arms, comprising:

a bag pack having plurality of bags stacked in alignment, each of said bags having opposed walls with outer surfaces, and a pair of upwardly extending handles, each with a flapless bag handle suspension arm receiving aperture formed therethrough, said opposed walls being closed at a bottom edge and at least partially openable at a top to define a mouth region between said pair of upwardly extending handles, a mouth tab portion being located on said opposed walls of each of said bags in said mouth region of said bags, said mouth tab portion having at least one mouth tab aperture formed therethrough, said walls of the plurality of individual bags of said pack of bags being held together by frangible bond means adjacent said flapless bag handle suspension arm receiving apertures and at least said one mouth tab aperture.

The invention further provides a flapless self-opening bag pack system comprising:

a bagging rack for mounting a pack of flapless self-opening bags and readying for loading individual bags from said pack of flapless self-opening bag, said rack comprising;

a base portion;

a rear wall portion extending upwardly from a rear region of said base portion, a pair of bag handle suspension arms, extending forwardly from an upper region of said rear wall portion over said base portion;

at least one upwardly and forwardly projecting bag tab mouth aperture engaging projection means; and a pack of flapless self-opening bags for use with said bagging rack, comprising;

a plurality of bags, aligned in a pack, each bag having a front wall and a rear wall;

side walls joining said front and rear walls, each bag being closed at a bottom edge;

a pair of integral handles extending upwardly from said top edge, with a mouth region located between said integral handles, each handle having a flapless handle aperture formed therethrough for receiving a bag handle suspension arm, with an area of frangible bonding means formed near a perimeter of said flapless handle aperture through the pack of bags; and mouth tab portions located on said front and rear walls in said mouth region of each said bag, said mouth tab portions having at least one mouth tab aperture passing through the pack of bags for receiving said bag pack mouth engaging projection means, wherein frangible bonding means are formed near at least a portion of the perimeter of the mouth tab apertures through the pack of self-opening bags.

The invention yet further provides a method for forming a pack of self-opening plastic bags having flapless handle apertures and mouth tab apertures mountable on a bagging rack, comprising the steps of:

stacking in alignment a plurality of flattened plastic bags sealed at top and bottom edges thereof;

providing dies having a forwardly lying sharp blade portion and a rearwardly lying blunt compression portion; and applying the dies to stack of flattened plastic bags such that the sharp blade portions cut through the stack of flattened plastic bags to form the flapless handle apertures and mouth tab apertures, and such that the blunt compression compresses layers of plastic of the bags together to thereby frangibly bond the stack of bags together in the vicinity of the flapless handle apertures and the mouth tab apertures.

The invention also provides dies for use in forming a pack of self-opening plastic bags having handle portions with a flapless handle apertures formed therethrough with a frangibly bound aperture perimeters area, and mouth tab portions with mouth tab apertures formed therethrough with a frangibly bound aperture perimeter area, said pack of bags being for use in conjunction with a bagging rack, said dies comprising:

a first die portion with a cutting edge for forming said handle aperture and said mouth tab aperture; and a compression portion with a generally blunt leading edge, positioned in close proximity to said first die portion, whereby when said die is applied to a pack of bags, the first die portion will cut through the pack of bags, thereby forming the flapless handle apertures and mouth tab aperture, and the compression portion will compress together layers of plastic material of adjacent plastic bags in the pack of bags, thereby forming perimeter areas of frangible bonding.

BRIEF DESCRIPTION OF THE DRAWINGS

FIG. 1 is a perspective view of a pack of self-opening bags of the invention;

FIG. 2 is a fragmentary perspective view of the upper area of a first embodiment of the pack of bags of FIG. 1, shown before the pack of bags is loaded on a bagging rack;

FIG. 3 is a partial perspective view of a die used to form circular apertures in the bag packs of FIGS. 1 and 2;

FIG. 4 is a partial cross-sectional view of the die through view lines 4—4 of FIG. 3;

FIG. 5 is a fragmentary perspective view of the upper region of a second embodiment of a pack of bags, shown before the pack of bags is loaded on a bagging rack;

FIG. 6 is a fragmentary perspective view of the upper region of a third embodiment of a pack of bags, shown before the pack of bags is loaded on a bagging rack;

FIG. 7 is a perspective view of the die used to form the frangibly bond slits of the third embodiment of the pack of bags of FIG. 6;

FIG. 10 is a perspective view of the first embodiment of the pack of bags of FIG. 1 hanging on a bagging rack of the invention, before an individual bag is readied for loading with merchandise;

DESCRIPTION OF THE PREFERRED EMBODIMENT

Figure 8:
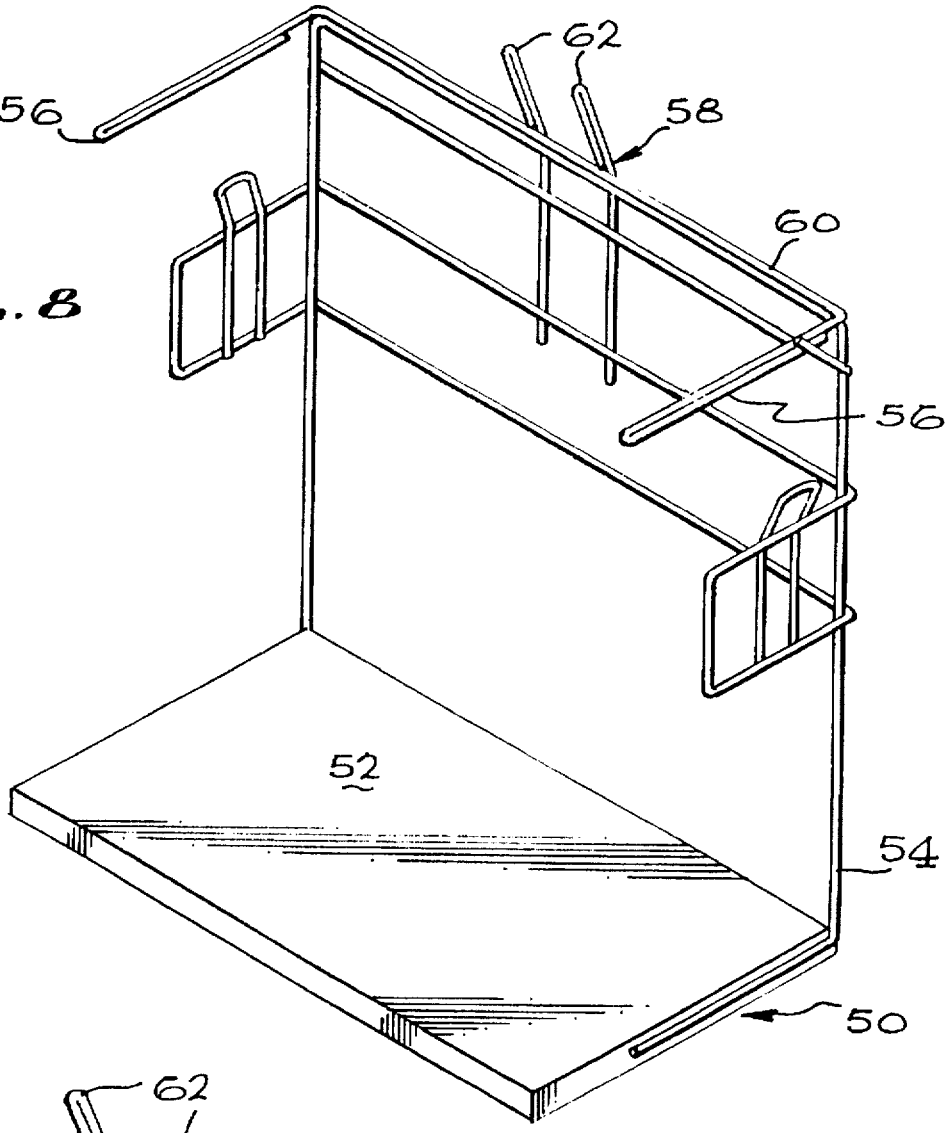
FIG. 8 is a perspective view of a bagging rack of the self-opening bag pack system of the invention.

Referring now more specifically to the drawings, reference numeral 10 designates the self-opening bag pack formed in accordance with the invention of multiple individual bags 12. Referring to FIGS. 1, 2, 11 and 13, each individual bag 12 has a lower body portion 14 with two loop handles 16 extending upwardly from the lower body portion 14, at opposite sides of the bags 12, with a mouth 18 thereby defined therebetween. The individual bags 12 each have a front wall 20, and a rear wall 22 joined together by pleated side walls 24. The T-shirt bags 12 are sealed together at their bottom edges 26 to form the lower body portion 14 and at their top edges 28 to form the loop handles 16. Heat seaming is the preferred method of sealing the bottom and top edges 26 and 28 of the bags 12, but other means can be employed, if desired. A mouth tab portion 30 extends upwardly from the top edges 32 of the front and rear walls 20 and 22 at the mouth 18 of the bags 12 between the two loop handles 16.

The mouth tab portion 30 in the embodiment of FIGS. 1, 2 and 10–13 preferably has two flap portions 32, each having a mouth hole 34 passing through the pack of self-opening bags 10. Surrounding at least a portion of the perimeter of the mouth holes 34 are areas of frangible cold pressure bonding 36 which frangibly bonds together adjacent layers of the plastic material of the bags 12 in the pack of self-opening bags 10. A tear initiating nick 38 is made at the upper portion of the flap portions 32, which nick 38 communicates with the mouth holes 34.

It is preferable for the area of the frangible bonding 36 not to impinge on the area of the perimeter of the mouth holes 34 through which the tear initiating nick 38 passes. As will be discussed further below, these mouth holes 34 are used to suspend the pack of bags 10 on a bagging rack 50.

The mouth tab portion 30 has a thumb notch relief area 44 between the two flap portions 32. The thumb notch relief area 44 permits the box person to easily pull open the first bag 12 in the pack of bags 10 to thereby initiate the self-opening feature of the pack of bags 10. The advantage of the two mouth hole 34 embodiment is that if the pack of bags 10 inadvertently tears through the mouth tab portion 30 at one mouth hole 34, the pack of bags 10 will still have another intact mouth hole 34 from which to hang it on the bagging rack 50.

The pack of self-opening bags 10 also have handle holes 40 passing through the handles 16 for use in suspending the pack of self-opening bags 10 on a bagging rack 50. These handle holes 40 have areas of frangible cold pressure bonding 42 around at least a portion of the perimeter of the handle holes 40. As in the case of the mouth holes 34 formed through the mouth tab portion 30, the frangible bonds 42 around the perimeter of the handle holes 40 frangible retain the layers of plastic material of the handles 16 of the pack of bag 10 in stacked alignment. The handle holes 40 do not have flaps which could interfere with the easy placement of a pack of bags 10 on a bagging rack 50.

The pack of self-opening bags 10 of the invention is designed to be used in conjunction with a bagging rack 50, such as that shown in FIG. 8. The bagging rack 50 has a support base 52, an upwardly extending rear wall portion 54, and two bag pack handle suspension arms 56 extending forwardly over the support base 52 from the rear wall portion 54. A bagging pack hook member 58 extends above a top edge 60 of the rear wall 54 and preferably projects upwardly and forwardly therefrom at an acute angle. The bagging rack hook member 58 is positioned approximately midway on the top edge 60 between the two bag pack handle suspension arms 56. The bagging rack hook member 58 has a pair of projections 62 which are spaced apart and project upwardly and preferably forwardly over the support base 52, such that the pack of self-opening bags 10 can be placed on the bagging rack 50 by looping the mouth holes 34 of the mouth tab portion 30 of a pack of self-opening bags 10 over the projection 62, as shown in FIGS. 10–13.

Figure 9:
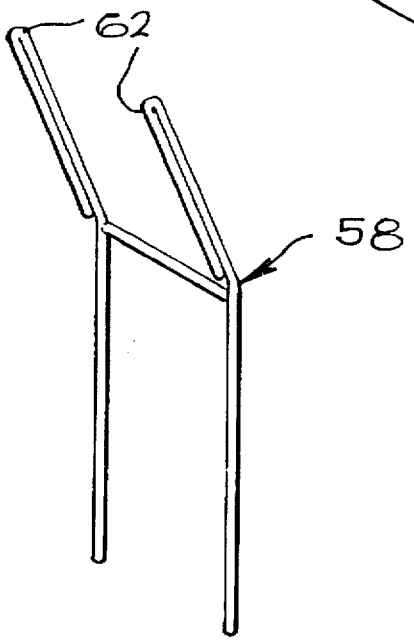
FIG. 9 is a perspective view of a mouth tab aperture engaging hook of the bagging rack.

FIG. 9 is a perspective view of one possible embodiment of the bagging rack hook member 58, with a pair of spaced apart projections 62 which can be affixed to a conventional bagging racks, without a pair of upwardly and forwardly projecting projections (not shown), to convert it to the bagging rack of FIG. 8.

The manufacturing process employed to manufacture the pack of self-opening bags 10 of the invention is similar to that used to manufacture conventional T-shirt bags, and does not require any additional steps. The advantages of the bag pack 10 of the invention derives from its design and the design of the dies used to form the frangibly bound perimetered mouth holes 34 and handle holes 40 in the pack of self-opening bags 10, as will now be discussed in detail.

Referring to FIGS. 3 and 4, the die portion 64 used to form the mouth holes 34 is unique, and creates the cold pressure frangible bonding 36 (See FIG. 2) which is necessary to provide the self-opening feature of the pack of self-opening bags 10. The die portion 64 has a cylindrical cutting portion 66 with a terminating sharp cutting edge 68. A blunt sleeve member 70 surrounds at least a portion of the outer perimeter of the cylindrical cutting portion 66 around its outer perimeter. The generally blunt leading edge 72 of the sleeve member 70 is set back slightly rearwardly from the cutting edge 68. The sleeve member 70 is preferably affixed directly adjacent to the cylindrical cutting portion 66, as by soldering, adhesives or welding, but can also be spaced slightly away from the outer perimeter of the cylindrical cutting portion 66. A nicking blade portion 76 is attached to the cylindrical cutting portion 66 and has a cutting edge 78 which is generally flush with the cutting edge 68 of the cylindrical cutting portion 66. It is this nicking blade portion which makes the tear initiating nick 38 in the pack of self-opening bags 10. The cylindrical cutting portion 66 is used to form the mouth holes 34 in the mouth tab portion 30. The blunt edge sleeve member 70 is used to form the frangible cold pressure bonds 36 surrounding the mouth holes 34.

The die used to form the handle holes 40 and the surrounding area of frangible cold pressure bonding 42 (not shown) in the perimeter region of the handle holes 40 is almost identical to the die portion used to form the mouth holes 34, except that it does not have a nicking blade portion 76, and its blunt sleeve member 70 used to form the frangible cold pressure bonding 42 around the handle holes 40 may surround the entire perimeter of the handle holes 40.

The die portion 64 is affixed to a die support plate 80, which die support plate 80 also carries other die member (not shown) which are used to cut the other feature (i.e. the handles, mouth and mouth tab portion) from the stack of pillowcases from which the pack of self-opening bags 10 is ultimately formed. When the die portion 64 and stack of pillowcases are brought into contact with each other, the cutting edge 68 of the cylindrical cutting portion 66 and the cutting edge 78 of the nicking blade portion 76 cleanly cut the mouth holes 34 and the tear initiating nicks 30, respectively, while the blunt leading edge 72 of the set back sleeve member 70 compresses the stacked layers of plastic around the perimeter of the mouth holes 34 under great pressure. This pressure causes the adjacent layers of plastic of the multiple stacked bags 12 to be compressed together, thereby forming the area of slight frangible bonding 36 between the layers of plastic around the mouth holes 34. This frangible bonding 36 not only contributes to the self-opening feature of the pack of bags 10, but also ensures that the thusly formed pack of bags 10 is retained in stacked alignment for easy loading on the bagging rack 50. The degree of frangible bonding can be increased by enlarging the surface contact area of the leading edge of sleeve member 72, such as by increasing the thickness of the blunt sleeve member 70 and/or by increasing the extent to which it surrounds the entire cylindrical cutting portion 66.

The handle holes 40 are formed in an equivalent manner, except that the die used to form the handle holes 40 will form no tear initiating nicks adjacent the handle holes 40 in the pack of self-opening bags 10.

FIG. 5 shows an alternate embodiment of a self-opening bag pack 90, wherein the mouth tab portion 92 has a single mouth hole 94 with a frangibly cold pressure bonded perimeter 96, and a tear initiating nick 98. The handle holes 100 have a frangibly cold pressure bonding perimeter area 102. The bagging rack for use with this embodiment will be similar to that shown in FIGS. 8 and 9, except that it has a bagging rack hook with a single mouth tab aperture receiving projection (not shown).

FIGS. 6 and 7 show a third embodiment of a pack of bags 110 of the invention, and the die member 122 used to form its frangibly bond slits 112 and 114, respectively.

In the embodiment of FIG. 6, instead of mouth holes and handle holes, mouth tabs slits 112 and handle slits 114 with areas of frangible cold pressure bonding 116 are used to hang the pack of bags 110 on the bagging rack 50. For the mouth tab portion 118, the frangible cold pressure bonding 116 can be formed on one or both sides of the mouth slit 112, as desired.

To prevent the handle slits 114 from tearing through the handles 16, tear guard slits 120 are located above and below the handle slits 114. These tear guard slits 120 are generally semi-circular in shape and are oriented to concavely face the handle slits 114. If for some reason the handle slits 114 are caused to tear through the handles 16 and propagate beyond their original position, then the lengthened handle slit 114 will intersect one or both tear guard slits 120, and thereby stop. The handle slit inwardly facing curvature of the tear guard slits 120 is designed to direct any tearing force which may be present inwardly towards the handle slits 114. If desired, areas of cold pressure frangible bonding 116 can be formed on the sides 121 of the tear guard slits 120 furthest from the handle slits 114.

The mouth slits 112, handle slits 114, and tear guard slits are formed with a die member 122 which has blade portion 124 having a sharp cutting edge 126, which cuts the slits 112, 114 and 120, and an adjacent blunt compression portion 128, with its generally flat leading edge 130 set back slightly from the sharp cutting edge 126 of the blade portion 124. The blade portion 124 and blunt compression portions are preferably permanently affixed together by soldering, spot welding, adhesives, or other known means, but can also be spaced slightly apart. The die member 122 is affixed to a mounting surface 132.

Referring to FIGS. 10–13, a pack or packs of self-opening bags 10 of FIG. 1 are placed on the bagging rack 50 by passing the handle holes 40 in the handles 16 over the bag pack handle suspension arms 56 of the bagging rack 50 and then engaging the mouth holes 34 of the mouth tab portion 30 with the projections 62 of the bagging rack hook member 38 on the rear wall portion 54.

Figure 11:
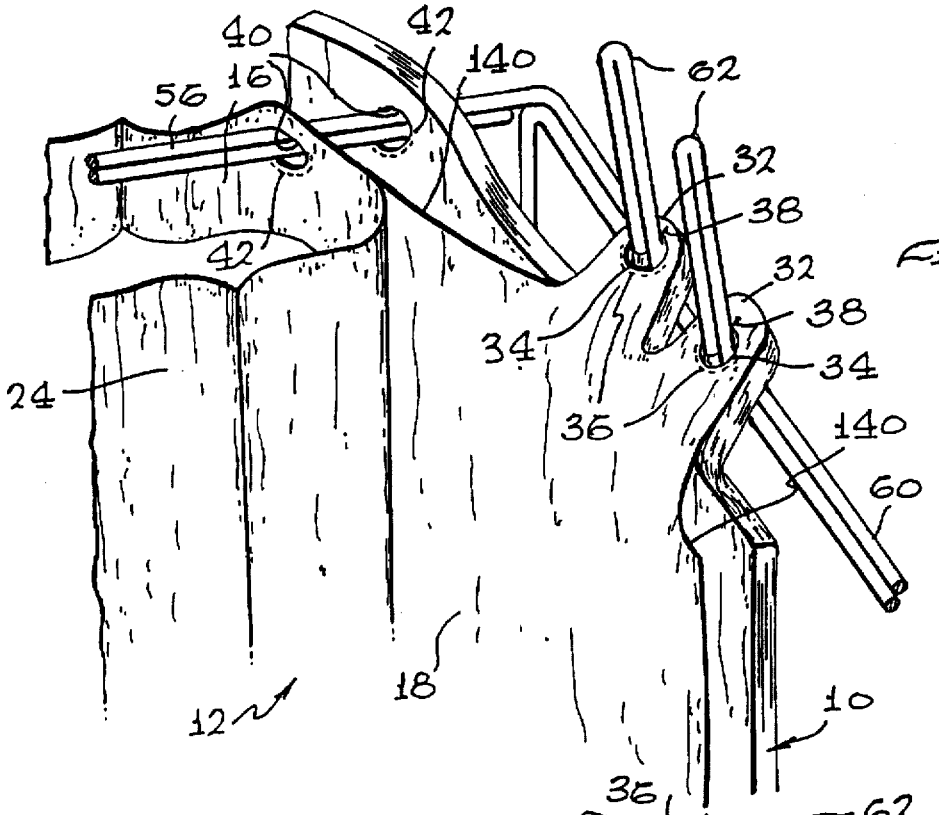
FIG. 11 is a partial perspective view of the first embodiment of the pack of bags of FIG. 1 hanging on the bagging rack of the invention, as a topmost bag is first opened up and released from the pack of bags.

Referring to FIG. 11, after loading a new pack or packs of self-opening bags 10 on the bagging rack 50, the checkout clerk or box person first grasps only the front wall 20 of the topmost bag 12 and pulls it forwardly to open the mouth 18 of the bag 12. The front wall 20 only of the topmost bag 12 will be torn free from the pack of self-opening bags 10 at its mouth tab portion 30 by virtue of the tear initiating nick 38 ripping through the mouth tab portion 30. The rear wall 22 of the top bag 12 will stay attached to the bagging hook member 58. After the topmost bag 12 is loaded with merchandise, its handles 16 are disengaged from the bag pack handle suspension arms 56 of the bagging rack by pulling the bag forwardly, and the loaded bag 12 is removed from the bagging rack 50. This action causes only the front wall 20 and side wall 24 of the next bag 12 in the pack of self-opening bags 10 to be pulled forward and automatically opened without any need for the checkout clerk or box person to grasp the material of the front wall 20 of the bag 12.

The self-opening feature of the pack of bags 10, and the consistency thereof, arises out of the frangible bonding 36 and 42 formed along the perimeters of the mouth holes 34 and handle holes 40.

The mechanics of the self-opening feature is described below, with reference to the pack of bags 10 of FIGS. 1 and 2 hanging on a bagging rack 50 of the kind shown in FIGS. 8 and 10. The self-opening mechanics will be the same for other styles of packs of self-opening bags 90 and 110 of FIGS. 5 and 6, respectively.

Figure 12:
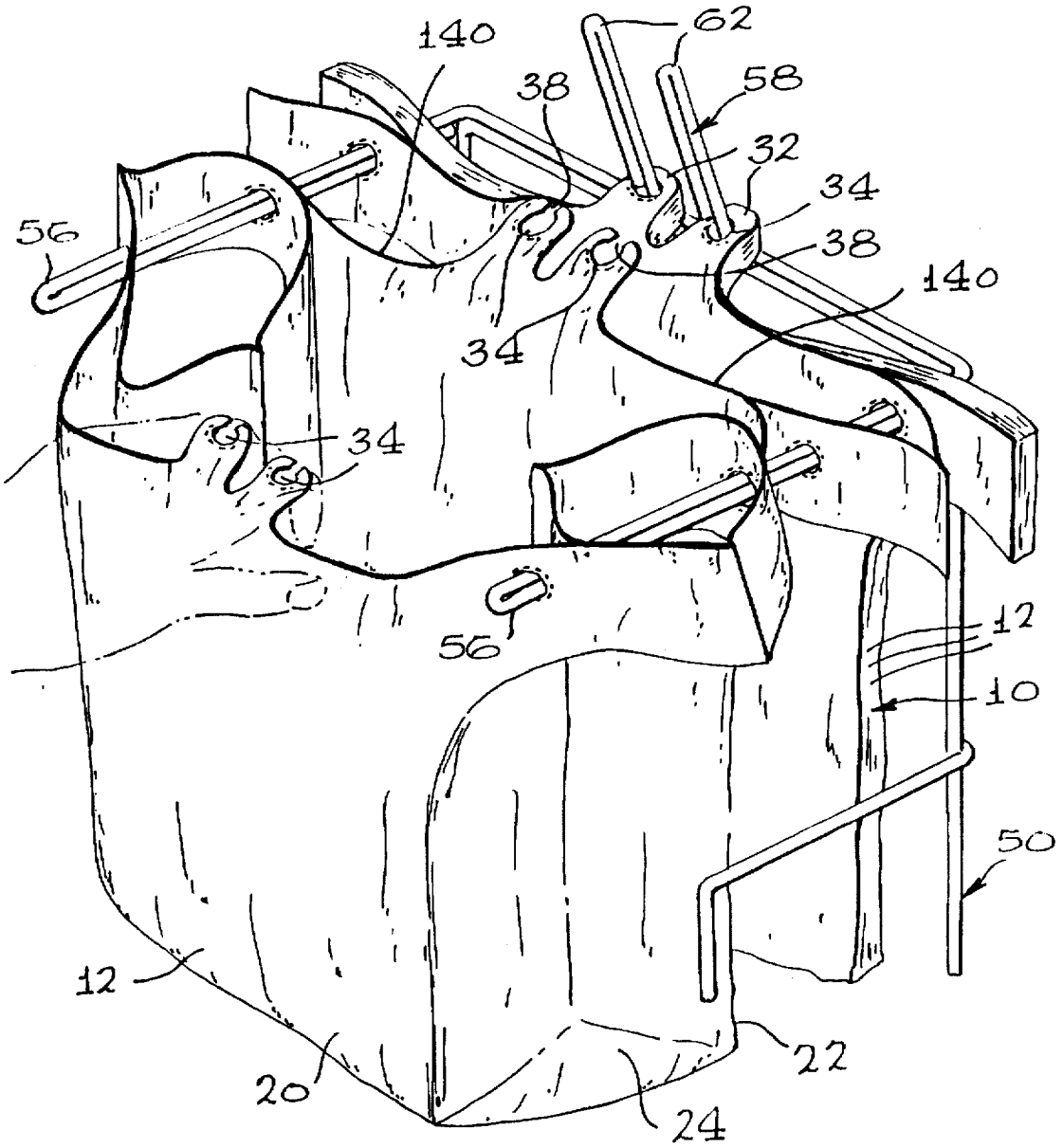
FIG. 12 is a perspective view of the bagging rack loaded with bags of FIG. 1, shown with the topmost bag of the pack of bags torn free from the tab hook of the bagging rack and opened up for loading with merchandise.
Figure 13:
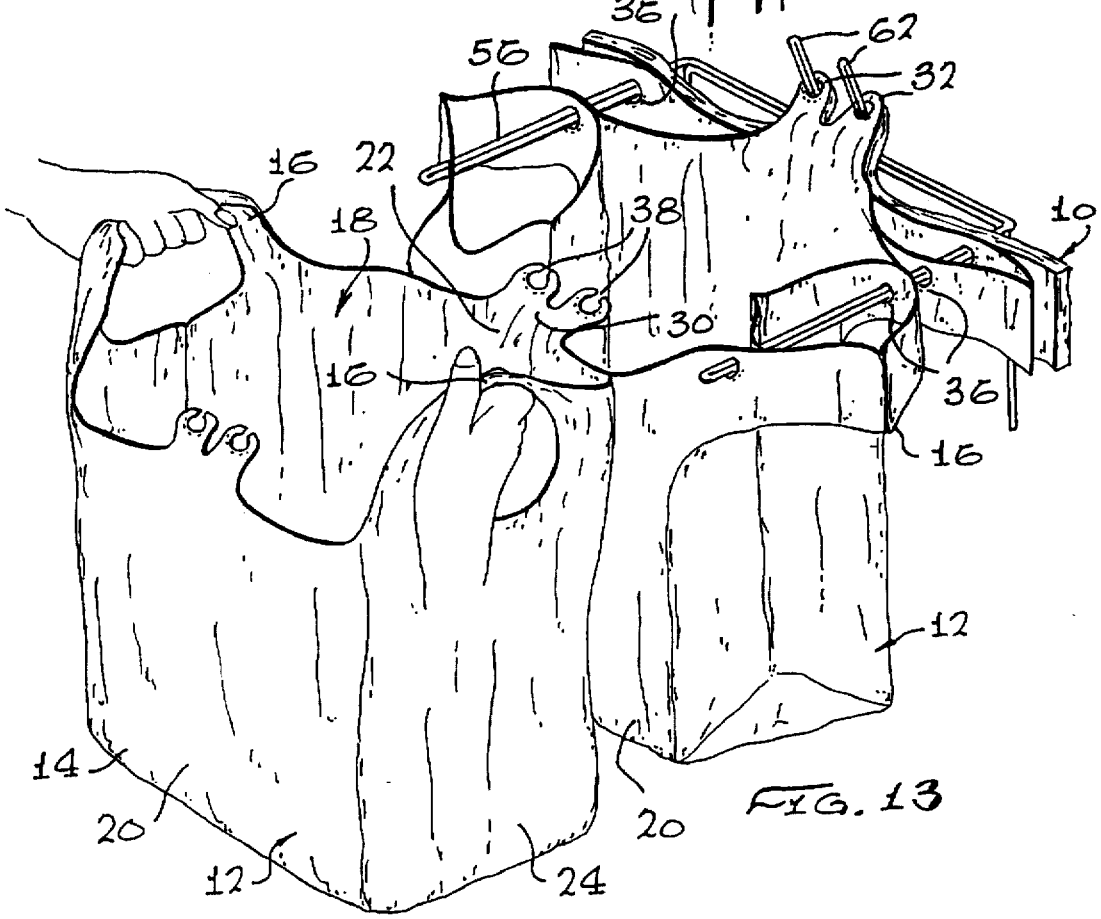
FIG. 13 is a further perspective view of the bag and pack of bags of FIG. 12 as the top bag is completely removed from the bagging rack and the next bag is automatically readied for loading.

As best shown in FIGS. 11 to 13, when the forwardly lying bag 12 is pulled forwardly to disengage it from the pack of self-opening bags 10, most of the forward pulling tension will be delivered along the top edges 140 of the bag's mouth 18 to the top region of the mouth holes 34, in the region of the tear initiating nick 38. This pulling tension causes the rear wall 22 of the top bag 12 and the front wall 20 of the next bag 12 to tear free from the pack of self-opening bags 10 at their mouth tab portions 30, along the tear initiating nick 38, leaving no portion of the bag 12 on the bagging rack 50. Because of the frangible bonding 42 of the front and rear walls 20 and 22 of adjacent bags 12 around the handle holes 40, and the slight adhesion between these layers of plastic material along the areas of frangible bonding 42, the action of pulling the front bag 12 will also pull forward only the front wall 20 of the immediately following bag 12, resulting in the next bag 12 in the pack of self-opening bags 10 opening up. Thereafter, by merely withdrawing consecutive bags from the top of the pack of self-opening bags 10 the bags 12 immediately following will open up without the box person needing to manually and individual disconnect just the front wall of material 20 of the topmost bag 12.

The ripping through of the tear initiating nicks 38 happens prior to the destruction of the frangible pressure bonding 36 surrounding the mouth holes 34, so the pulling tension caused by pulling a bag 12 off the rack 50 will cause the next bag 12 in the pack of self-opening bags 10 to open up. Thereafter, very slight pulling of the frontmost bag 12 will separate it from the next bag 12 which still is frangibly bonded to it around the mouth holes 34 and/or handle holes 40.

It is important that the pack of self-opening bags 10 be retained on the bagging rack 50 at its mouth tab portion 30, otherwise the pulling tension will tend to pull the entire pack of self-opening bags 10 forwards, which interferes with the efficient self-opening function.

While the self-opening bag packs 10 has been described with respect to the embodiments of FIGS. 1, 2, 5 and 6, other embodiments, having bag handle apertures and mouth tab apertures other than in the form of circular holes and slits can be utilized.

As can be appreciated, the self-opening feature of the pack of self-opening bags 10 is accomplished by a simple and reliable method of manufacture.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. Dies for use in forming a pack of self-opening plastic bags having handle portions with flapless handle apertures formed therethrough with frangibly bonded aperture perimeters areas, and mouth tab portions with mouth tab apertures formed therethrough with frangibly bonded aperture perimeter areas, said pack of bags being for use in conjunction with a bagging rack, each of said dies comprising:

a first die portion with a sharp cutting edge for forming said handle apertures and said mouth tab apertures; and a compression portion with a generally blunt leading edge, positioned in close proximity to said first die portion, whereby when each said die is applied to a pack of bags, the first die portion will cut through the pack of bags, thereby forming the flapless handle apertures and mouth tab apertures, and the compression portion will compress together the layers of plastic material of adjacent plastic bags in the pack of bags, thereby forming said perimeter areas of frangible bonding.

2. The dies of claim 1, wherein the cutting edge of said first die portion extends forward of the generally blunt leading edge of the compression portion.

3. The dies of claim 1, wherein the compression portion is attached directly to the first die portion.

4. The dies of claim 1, wherein the compression portion is spaced slightly away from the first die portion.

5. The dies of claim 1, wherein the first die portion has a circular cutting profile, and wherein the compression portion has a semi-circular compression profile.

6. The dies of claim 5, wherein the first die portions used for cutting the mouth tab apertures further comprise a nicking blade portion extending outwardly from the circular cutting profile for nicking the stack of bags adjacent the circular apertures formed by the circular cutting profiles.

7. The dies of claim 1, wherein the first die portion has a generally elongate, straight cutting blade with two generally elongate, straight sides, and the compression portion is located on at least one of the two sides, in order to form the flapless handle apertures and mouth tab apertures as generally vertical slits.

8. The dies of claim 7, wherein the dies further comprise dies for forming a generally semi-circular tear guard slit above and below, and concavely facing, each of the flapless handle slits, each of the tear guard slit forming dies having a first die portion with a sharp cutting edge in the form of a generally semi-circular cutting profile.

* * * * *